US010011390B2

(12) United States Patent
Lim

(10) Patent No.: US 10,011,390 B2
(45) Date of Patent: Jul. 3, 2018

(54) PREFABRICATED PALLET

(71) Applicant: Sangjin ARP Co., Ltd., Cheongju-si (KR)

(72) Inventor: Jae Sung Lim, Chungcheongbuk-do (KR)

(73) Assignee: SANGJIN ARP CO., LTD., Cheongju-si (KR)

( * ) Notice: Subject to any disclaimer, the term of this patent is extended or adjusted under 35 U.S.C. 154(b) by 0 days.

(21) Appl. No.: 15/319,371

(22) PCT Filed: Nov. 25, 2015

(86) PCT No.: PCT/KR2015/012702
§ 371 (c)(1),
(2) Date: Dec. 16, 2016

(87) PCT Pub. No.: WO2016/104963
PCT Pub. Date: Jun. 30, 2016

(65) Prior Publication Data

US 2017/0152073 A1 Jun. 1, 2017

(30) Foreign Application Priority Data

Dec. 22, 2014 (KR) ..... 10-2014-0185944

(51) Int. Cl.
*B65D 19/06* (2006.01)
*B65D 19/38* (2006.01)

(52) U.S. Cl.
CPC ..... *B65D 19/06* (2013.01); *B65D 19/385* (2013.01); *B65D 2519/0098* (2013.01);
(Continued)

(58) Field of Classification Search
CPC ..... B65D 19/00; B65D 19/44; B65D 2519/00547; B65D 2519/00368; B65D 2519/00552
(Continued)

(56) References Cited

U.S. PATENT DOCUMENTS 3,878,796 A * 4/1975 Morrison ..... B65D 19/0075 108/56.1
4,145,976 A * 3/1979 Svirklys ..... B65D 19/0095 108/56.1
(Continued)

FOREIGN PATENT DOCUMENTS

JP 2003-276791 A 10/2003
KR 20-0347736 Y1 4/2004
(Continued)

*Primary Examiner* — Jose V Chen
(74) *Attorney, Agent, or Firm* — KORUS Patent, LLC; Seong Il Jeong

(57) ABSTRACT

Provided is a prefabricated pallet including a vertical member having a first coupling part formed in a longitudinal direction in which first side holding plates are formed on an upper or lower surface of the vertical member so as to be directed toward the center thereof and provide a first insertion space and a first holding space; a horizontal member having a second coupling part formed in a longitudinal direction in which second side holding plates are formed on a lower surface of the horizontal member so as to be directed toward the center thereof and provide a second insertion space and a second holding space; and a bracket that includes upper and lower insertion plates inserted into the first insertion space and the second insertion space and column plates inserted into the first holding space and the second holding space and formed between the upper and lower insertion plates.

8 Claims, 9 Drawing Sheets

(52) U.S. Cl.
CPC ..... *B65D 2519/00273* (2013.01); *B65D 2519/00293* (2013.01); *B65D 2519/00323* (2013.01); *B65D 2519/00542* (2013.01); *B65D 2519/00572* (2013.01)

(58) Field of Classification Search
USPC ..... 108/56.1, 56.3, 51.11, 55.1
See application file for complete search history.

(56) References Cited

U.S. PATENT DOCUMENTS 5,367,960 A * 11/1994 Schleicher ..... B65D 19/0095 108/56.1
5,402,735 A * 4/1995 DeJean ..... B65D 19/0081 108/56.1
5,458,069 A * 10/1995 Stolzman ..... B29C 65/561 108/56.3
5,809,902 A * 9/1998 Zetterberg ..... B65D 19/0069 108/51.11
5,941,179 A * 8/1999 Herring ..... B65D 19/0091 108/56.3
6,105,512 A * 8/2000 Lin ..... B65D 19/0073 108/55.5
6,766,749 B2 * 7/2004 Lacabanne ..... B65D 19/0085 108/56.3
6,837,170 B2 * 1/2005 Taft ..... B65D 19/0073 108/57.25
7,469,643 B2 * 12/2008 Isle ..... B65D 19/0095 108/51.11
7,490,561 B1 * 2/2009 Chou ..... B65D 19/0095 108/56.1
7,578,244 B2 * 8/2009 Williams, Jr. ..... B65D 19/0095 108/56.3
7,673,569 B2 * 3/2010 Ishikawa ..... B65D 19/385 108/55.1
7,987,798 B2 * 8/2011 Kim ..... B65D 19/0095 108/51.11
8,448,582 B2 * 5/2013 Jian ..... B65D 19/0097 108/56.3
8,578,862 B1 * 11/2013 Shirley ..... A47B 85/06 108/12
9,016,212 B2 * 4/2015 Valiulis ..... G09F 23/06 108/27
9,409,674 B2 * 8/2016 Hidalgo Vargas . B65D 19/0097
2002/0096445 A1 * 7/2002 Austin ..... B65D 19/38 206/386
2006/0032412 A1 * 2/2006 Harner ..... B65D 19/06 108/55.1
2006/0196394 A1 * 9/2006 Bailey ..... B65D 19/0048 108/56.1
2007/0245932 A1 * 10/2007 Nielsen ..... B65D 19/0093 108/51.11
2008/0066657 A1 * 3/2008 Kuo ..... B65D 19/0095 108/57.19
2013/0032064 A1 2/2013 Randall
2014/0000494 A1 * 1/2014 Gysin ..... B65D 19/0095 108/56.3
2015/0360808 A1 * 12/2015 Marconel Carpio ..... B65D 19/0095 108/56.3

FOREIGN PATENT DOCUMENTS

KR 10-0556708 B1 3/2006
KR 10-0987566 B1 10/2010

* cited by examiner (a)

(b)

PREFABRICATED PALLET

TECHNICAL FIELD

The present invention relates to a prefabricated pallet.

BACKGROUND ART

In case of loading or transporting raw material products, semi-finished products, or finished products using a transport means such as a forklift or the like on factory floors and warehouses for various products, a pallet has been usually used to serve as a support for target products to be loaded or transported.

Such a pallet used for transporting and loading products has been manufactured by arranging a plurality of members, such as timber members having a uniform thickness, to orthogonally intersect with each other and fixing and connecting them with separate fixing means such as nails. However, in this case, there are various problems such as a long manufacturing period of time required for assembly, non-recyclability, and non-easiness of modification. Therefore, the inventors of the present invention suggested a pallet manufactured so as to be assembled in order to improve the efficiency in assembly, recovery, and transport of the pallet in the prior art document, Korean Patent No. 10-0987566 entitled "A prefabricated pallet".

As for the prior art suggested herein, a pallet with an improved structure has a reduced weight and is provided with efficiency in assembly and disassembly, so that it is possible to reduce costs required for loading and unloading goods and also possible to transport goods more quickly.

However, regarding the prior art suggested above, various techniques for further improving the efficiency in transport and suppressing damage to a member which may occur during transport of a pallet using a transport means are being demanded.

DISCLOSURE

Technical Problem

The present invention is conceived to solve the above-described problem. An object of the present invention is to provide various techniques for improving time and cost efficiency in assembly and disassembly of a prefabricated pallet and improving efficiency in transport of the assembled pallet loaded with goods using a transport means.

Technical Solution

In order to achieve the above object, a prefabricated pallet of the present invention includes: a vertical member having a first coupling part formed in a longitudinal direction in which first side holding plates having a shape of "⌈" and "⌉" are formed on an upper or lower surface of the vertical member so as to be directed toward the center thereof and provide a first insertion space and a first holding space; a horizontal member having a second coupling part formed in a longitudinal direction in which second side holding plates having a shape of "⌈" and "⌉" are formed on a lower surface of the horizontal member so as to be directed toward the center thereof and provide a second insertion space and a second holding space; and a bracket that includes upper and lower insertion plates inserted into the first insertion space and the second insertion space and column plates inserted into the first holding space and the second holding space and formed between the upper and lower insertion plates, and third insertion spaces are provided on both sides of the vertical member in the longitudinal direction.

Herein, the vertical member is orthogonally connected through the bracket with a predetermined gap on the lower surface of the horizontal member, and the prefabricated pallet further includes: a protection member that protects the horizontal member from a fork of transport device inserted into a space between adjacent vertical members for transport of the prefabricated pallet using a protective surface that is inserted into the space between the adjacent vertical members connected on the lower surface of the horizontal member and covers one side of the horizontal member, and a pair of protection member fixing parts respectively inserted into the third insertion spaces facing each other between the adjacent vertical members are formed on both sides of the protection member.

Further, the protection member is formed of a material having elasticity, and the protective surface covering the one side of the horizontal member is formed into a curved shape with a predetermined curvature.

Furthermore, the prefabricated pallet further includes: auxiliary banding members that are inserted into the third insertion spaces and provide coupling spaces for a banding means to be fastened.

Moreover, an inner space of the vertical member is formed into a grid pattern divided by a plurality of rectangular frames.

Further, the prefabricated pallet further includes: a connection member that is installed between a plurality of vertical members arranged in a longitudinal direction and connects a back surface part of one vertical member to a front surface part of another vertical member.

Herein, the connection member includes: a body which provides a space where the fork of transport device is inserted since one side of a lower part of the body is opened in a width direction and includes a third coupling part having the same shape as the first coupling part on an upper surface thereof; and a connection part protruded from both sides of the body and extended so as to be inserted and coupled to a front surface part or back surface part of the vertical member.

Further, the connection part has a structure corresponding to a divided grid pattern of the vertical member so as to be inserted into the inner space through the front surface part or back surface part of the vertical member.

Herein, a first insertion hole through which a separation prevention means is inserted is formed in an upper part of the vertical member, and a second insertion hole is formed on one side of the connection part in a height direction at a position corresponding to the first insertion hole.

Further, the prefabricated pallet further includes: a wall member fixing column that is coupled to an upper edge of the horizontal member and provides a coupling space for a wall member, and the wall member fixing column includes: a column part that is formed into a column shape and includes a third insertion hole through which a column fixing means for coupling to an upper part of the horizontal member is inserted at the center thereof; inner and outer insertion plates that are formed in one orthogonal direction of the column part and provide a coupling space for insertion and fixing of the wall member; a contact plate formed in the other orthogonal direction of the column part and provides a coupling space for standing and fixing the wall member; and a rotating part of which one end is connected to a lateral surface of the inner insertion plate toward the column part and the other end is connected to one side of the column part adjacent to the inner insertion plate in order for the inner insertion plate to be rotatable around the other end connected to the one side of the column part.

Effect

According to the present invention, a prefabricated pallet can suppress damage to a horizontal member caused by insertion of a fork of transport device using a protection member inserted and provided between adjacent vertical members and can also guide the fork through an insertion path.

Further, according to the present invention, in the prefabricated pallet, auxiliary banding members are provided on both outer surfaces of the outermost vertical members among the provided vertical members, so that knot tying spaces for enhancing a fastening force of a banding means for fixing goods loaded on the pallet can be provided.

Furthermore, according to the present invention, the prefabricated pallet is assembled into a grid pattern using a connection member that connects a plurality of vertical members in a longitudinal direction and provides an open space under a main body, so that an additional fork insertion space is provided. Therefore, the fork of transport device can be selectively inserted from four directions.

Moreover, according to the present invention, the prefabricated pallet may be manufactured into a box shape in order for a wall member to protect goods loaded using a wall member fixing column and the wall member. Further, an inner insertion plate of the wall member fixing column is prepared to be rotatable, so that when the pallet is disassembled, the wall member can be easily disassembled.

BEST MODE

Hereinafter, Hereinafter, exemplary embodiments of the present invention. will be described in more detail with reference to the accompanying drawings, and explanations of well-known technical parts will be omitted or compressed for clarity.

1. Explanation of Components of Prefabricated Pallet

Figure 1:
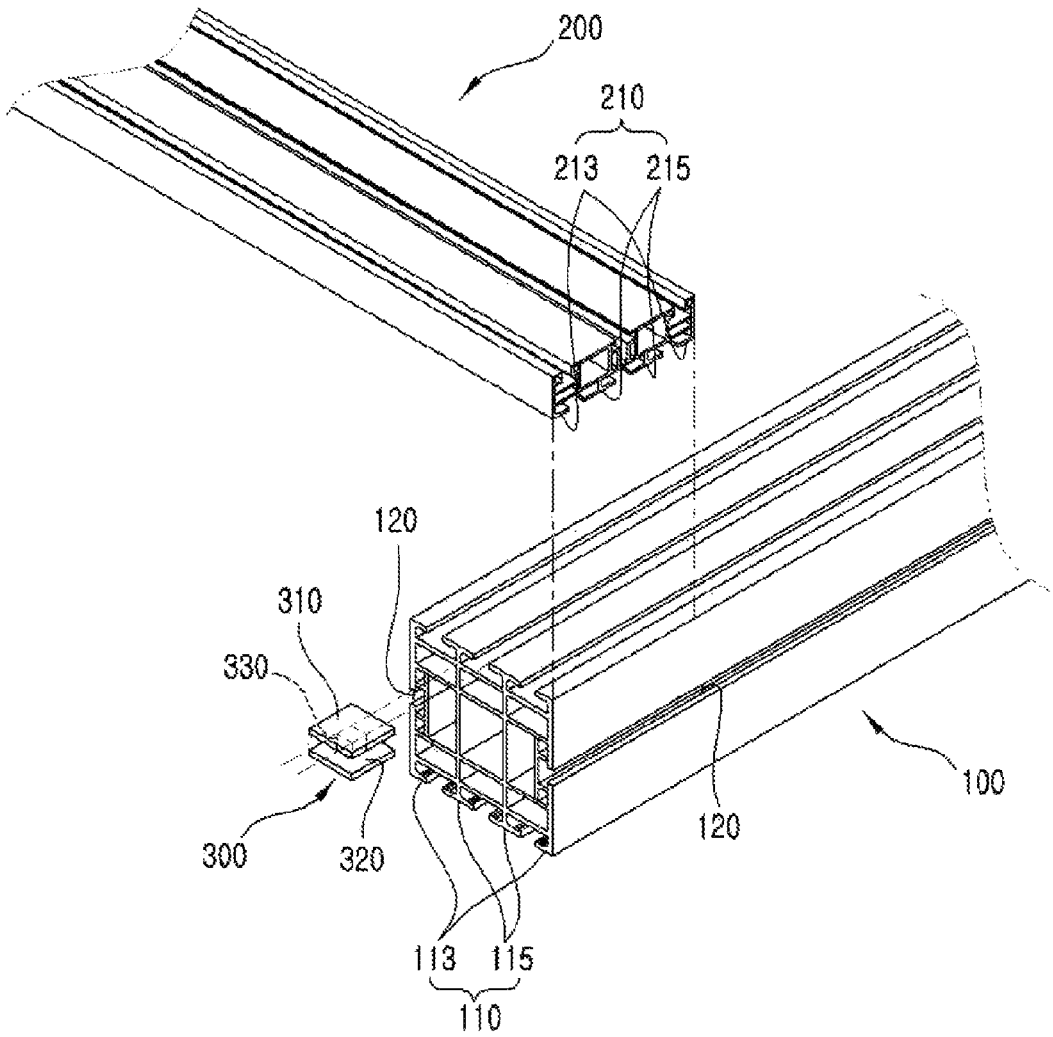
FIG. 1 is a perspective view illustrating a prefabricated pallet according to the present invention.
Figure 2:
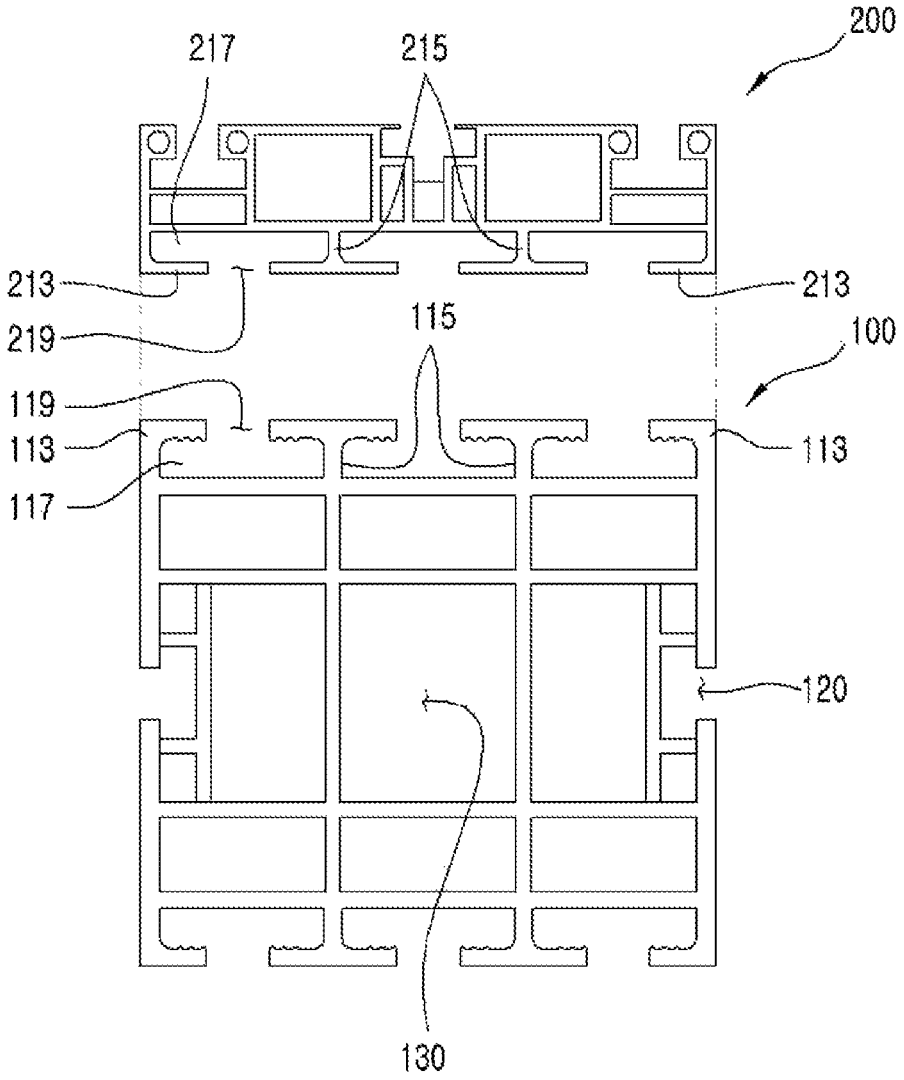
FIG. 2 is a cross-sectional view illustrating a horizontal member and a vertical member according to the present invention.
Figure 3:
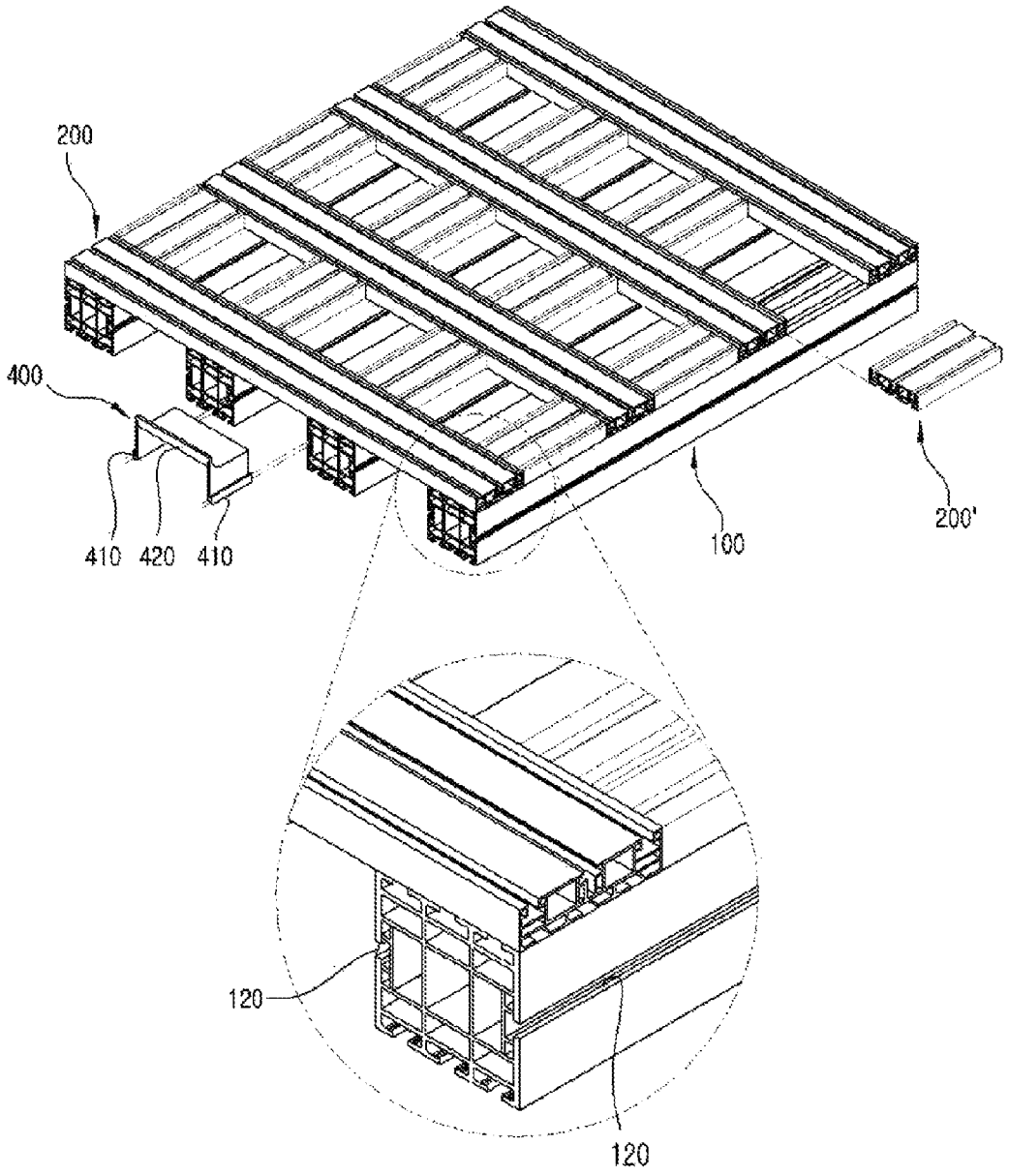
FIG. 3 and FIG. 4 are perspective views illustrating coupling between the horizontal member and the vertical member and coupling between the horizontal member and a protection member according to the present invention.

Referring to FIG. 1 to FIG. 3, a prefabricated pallet of the present invention prepared by assembly will be described. The prefabricated pallet preferentially includes a vertical member 100, a horizontal member 200, and a bracket 300.

As illustrated in FIG. 1 and FIG. 2, the vertical member 100 includes a first coupling part 110 as one body in a longitudinal direction in which first side holding plates 113 having a shape of "⌈" and "⌉" are formed on an upper or lower surface of the vertical member 100 so as to be directed toward the center thereof and provide a first insertion space 117 and a first holding space 119.

Herein, more specifically, in a structure of the first coupling part 110, one or a plurality of first center holding plates 115 having a shape of "⊤" can be formed between a pair of first side holding plates 113 formed to face each other on one side and the other side of an upper surface of the first coupling part 110 as illustrated in FIG. 2. In this case, the first insertion space 117 and the first holding space 119 are uniformly provided between the first side holding plates 113 and the first center holding plates 115.

Further, an inner space 130 of the vertical member 100 is formed into a grid pattern divided by a plurality of rectangular frames as illustrated in FIG. 2. The grid-type inner space 130 functions to provide stability in coupling force when a connection member 600 to be described below is coupled.

Furthermore, third insertion spaces 120 are provided on both sides of the vertical member 100 in the longitudinal direction as illustrated in FIG. 1.

The third insertion spaces 120 are formed in pairs corresponding to the both sides of the vertical member, respectively. These spaces serve as spaces for insertion and coupling of various multipurpose members to be described below.

The vertical→horizontal member 200 includes a second coupling part 210 as one body in a longitudinal direction in which second side holding plates 213 having a shape of "⌈" and "⌉" are formed on a lower surface of the horizontal member 200 so as to be directed toward the center thereof and provide a second insertion space 217 and a second holding space 219. The second coupling part 210 has the same shape as the first coupling part 110.

Herein, more specifically, in a structure of the second coupling part 210, one or a plurality of second center holding plates 215 having a shape of "⊤" can be formed between a pair of second side holding plates 213 formed to face each other on one side and the other side of a lower surface of the second coupling part 210 as illustrated in FIG. 2. In this case, the second insertion space 217 and the second holding space 219 are uniformly provided between the second side holding plates 213 and the second center holding plates 215.

Further, a plurality of protrusions may be formed as one body on inner surfaces of the first coupling part 110 and the second coupling part 120 of the vertical member 100 and the horizontal member 200. To be specific, protrusions may be preferably formed on inner surfaces of the first and second insertion spaces 117 and 217.

Furthermore, both ends of the vertical member 100 and the horizontal member 200 may be finished with covers. In order to mount the covers, cover mounting grooves may be formed on both is end surfaces of the vertical member and the horizontal member, so that fixing forces between the covers and the members 100 and 200 are increased. Thus, separation can be suppressed.

The bracket 300 is formed using upper and lower insertion plates 310 and 320 inserted into the first insertion space 117 and the second insertion space 217 and a column plate 330 formed between the upper and lower insertion plates 310 and 320 so as to be inserted into the first holding space 119 and the second holding space 219.

Herein, the bracket 300 serves as a medium that connects the vertical member 100 and the horizontal member 200 to each other while the upper and lower insertion plates 310 and 320 are inserted into the first insertion space 117 and the second insertion space 217 and the column plate 330 is also inserted into the first holding space 119 and the second holding space 219.

More specifically, the bracket 300 is moved to a position where the horizontal member 200 will be located by inserting the lower insertion plate 320 into the first insertion space 117 within the first coupling part 110 of the vertical member 100 and then, the horizontal member 200 is arranged as being orthogonally coupled such that the upper insertion plate 310 is inserted into the second insertion space 217 within the second coupling part 210 of the horizontal member 200, so that a pallet is formed into a grid pattern with rectangular spaces each having a predetermined space as illustrated in FIG. 3.

Meanwhile, a spacer 200' may be prepared by cutting the horizontal member 200 into a proper size in order to maintain a predetermined gap in a space between the horizontal members 200 orthogonally coupled to the vertical member 100 and then installed in the space between the horizontal members 200 so as to be orthogonal to an arrangement direction of the horizontal member 200 and located on the vertical member 100A.

Thus, a prefabricated pallet having a predetermined height is prepared. Accordingly, the spacer 200' prepared using the horizontal member 200 serves as a gap adjusting means for the horizontal members 200.

2. Explanation of Coupling and Function of Multipurpose Member (Protection Member) of Prefabricated Pallet Referring to FIG. 3 to FIG. 5, the prefabricated pallet of the present invention may be prepared as a pallet having a grid pattern and serving as a support plate for transport of goods as illustrated in FIG. 3 by combination of the vertical member 100, the horizontal member 200, and the bracket 300. A protection member 400 may be further combined using the third insertion spaces 120 provided on both sides of the vertical member 100 within the prefabricated pallet in a longitudinal direction, so that it is possible to suppress damage to a part and separation from an insertion position which may occur when a fork 10 of transport device is inserted into the prefabricated pallet.

The protection member 400 protects the horizontal member 200 which may be damaged when the fork 10 of transport device is inserted using a protective surface 420 which is inserted into a space formed between adjacent vertical members 100 among the vertical members 100 arranged with a predetermined gap on the lower surface of the horizontal member 200 as illustrated in FIG. 3, more specifically a space where the fork 10 of transport device is inserted to lift the pallet, and covers one side of the horizontal member 200.

Herein, on both sides of the protection member 400, a pair of protection member fixing parts 410 are formed so as to be inserted into the space formed between the adjacent vertical members 100 to fix the position and respectively inserted into a pair of third insertion spaces 120 facing each other between the adjacent vertical members 100 to be guided along a moving path.

Figure 4:
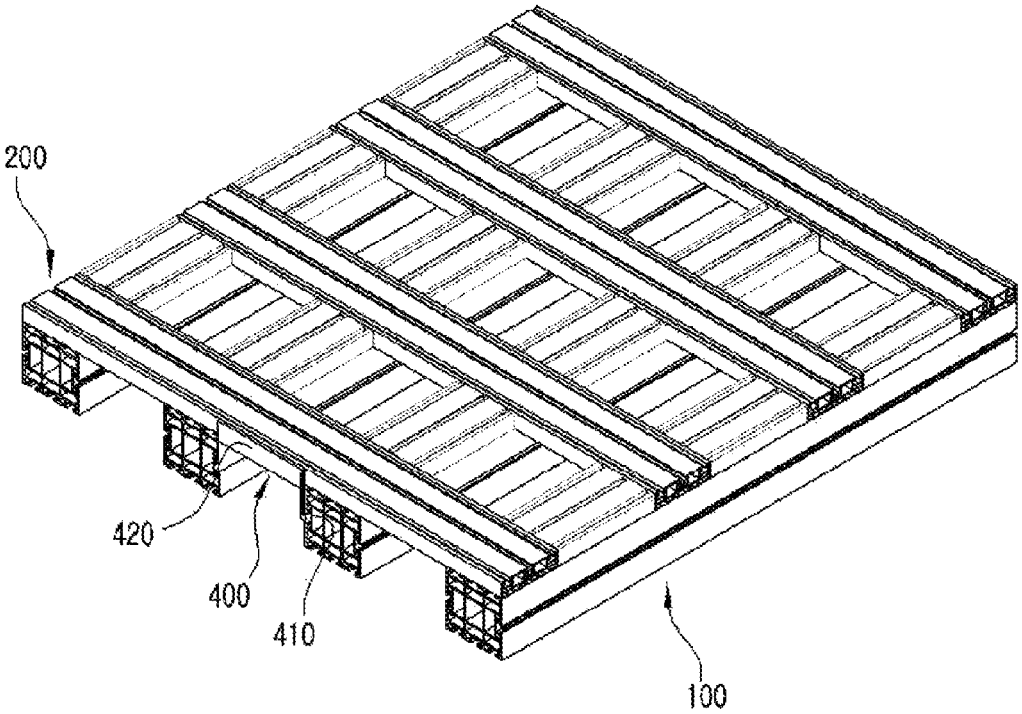
Figure 5:
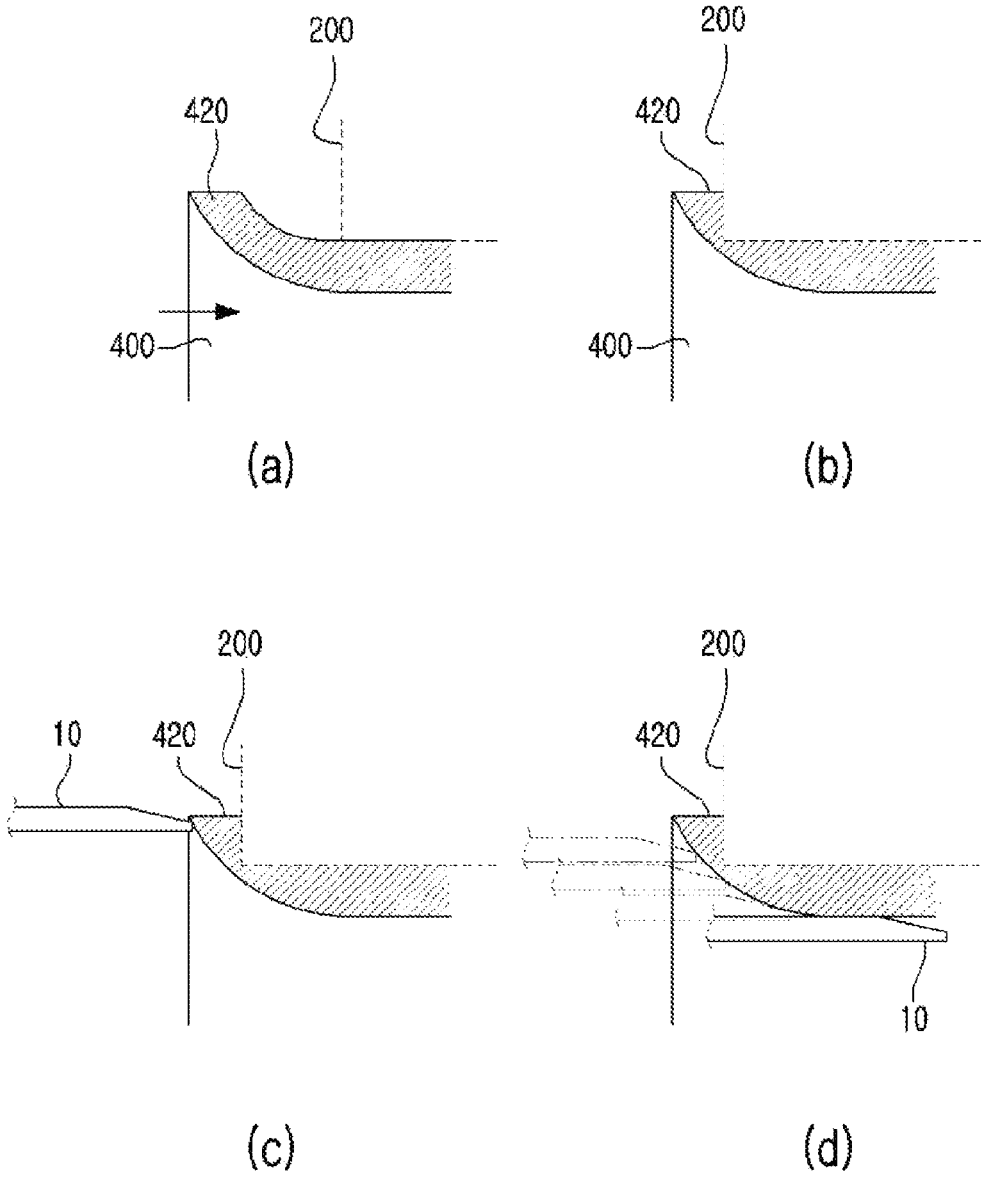
FIG. 5 schematically illustrates a function of protecting the horizontal member when the protection member is installed and a fork is inserted according to the present invention.

As magnified in FIG. 4, the inserted protection member 400 covers up one side of the horizontal member 200 with the protective surface 420, and the protective surface 420 is formed into a curved shape with a predetermined curvature.

Further, the protection member 400 is formed of a material having elasticity such that when the protection member 400 is inserted, an inner side of the protective surface 420 is modified to match with a shape of one edge of the horizontal member 200 as illustrated in FIG. 5A and FIG. 5B and its outer side to which the fork 10 of transport device is inserted maintains the shape with a predetermined curvature so as to serve as a buffer when the fork 10 of transport device is inserted and also guide the fork 10 being inserted in wrong position to a space on the lower side.

Figure 6:
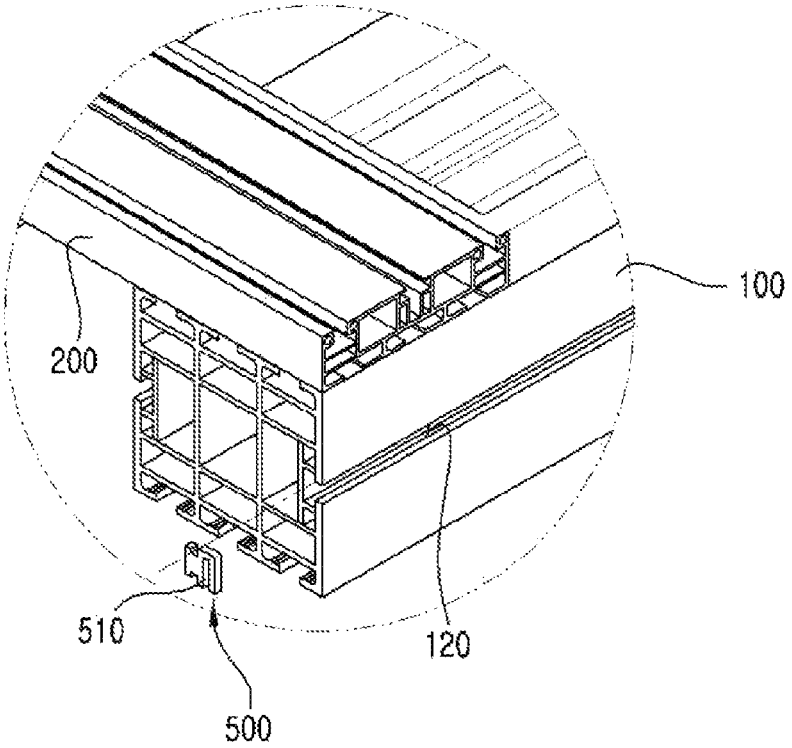
FIG. 6 is a perspective view illustrating coupling of an auxiliary banding member according to the present invention.

3. Explanation of Coupling and Function of Multipurpose Member (Auxiliary Banding Member) of Prefabricated Pallet Referring to FIG. 6, the prefabricated pallet of the present invention may be prepared as a pallet having a grid pattern and serving as a support plate for transport of goods as illustrated in FIG. 3 by combination of the vertical member 100, the horizontal member 200, and the bracket 300. Auxiliary banding members 500 may be further combined using the third insertion spaces 120 provided on both sides of the vertical member 100 within the prefabricated pallet in the longitudinal direction, so that there are provided knot tying spaces 510 for enhancing a fixing force of a banding means configured to band various goods loaded on the prefabricated pallet so as not to be separated from the pallet while being transported and unloaded.

The auxiliary banding member 500 is inserted into the third insertion space 120 and provides a coupling space 510 for the banding means to be fastened. Herein, the auxiliary banding member 500 includes an insertion part to be inserted into the third insertion space 120, and preferably, the auxiliary banding member 500 may be installed with a fixing means which is inserted additionally and fixed at a predetermined position.

Further, preferably, the auxiliary banding member 500 may be inserted into each of the outer third insertion spaces 120 of the outermost vertical members 100 on the prefabricated pallet prepared by combination of the vertical member 100, the horizontal member 200, and the bracket 300 so that the banding means can cut across the pallet from one side to the other side and tie knots in the respective auxiliary banding members 500 inserted into the outer third insertion spaces 120 on the both sides so as to fasten goods.

4. Explanation of Coupling and Function of Multipurpose Member (Connection Member) of Prefabricated Pallet Referring to FIG. 6, the prefabricated pallet of the present invention may be prepared as a pallet having a grid pattern and serving as a support plate for transport of goods as illustrated in FIG. 3 by combination of the vertical member 100, the horizontal member 200, and the bracket 300. The auxiliary banding members 500 may be further combined using the third insertion spaces 120 provided on both sides of the vertical member 100 within the prefabricated pallet in the longitudinal direction, so that there are provided the knot tying spaces 510 for enhancing a fixing force of the banding means configured to band various goods loaded on the prefabricated pallet so as not to be separated from the pallet while being transported and unloaded.

Figure 7:
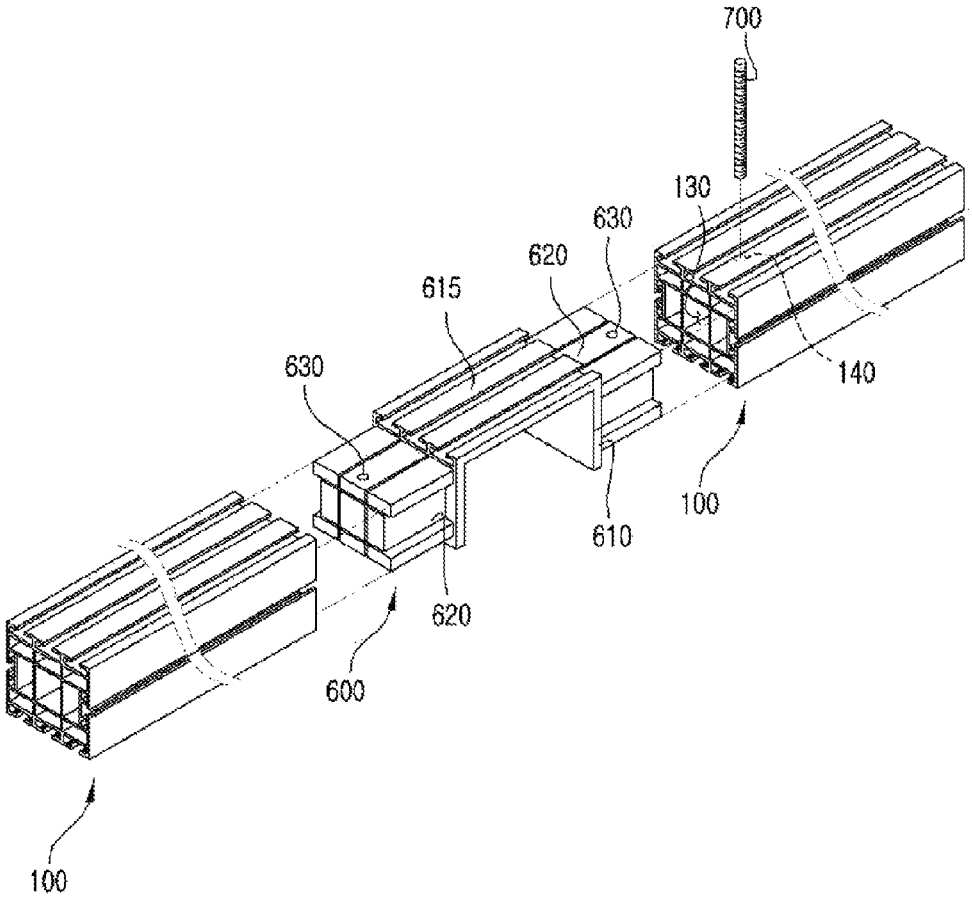
FIG. 7 is a perspective view illustrating coupling of a connection member according to the present invention.

A connection member 600 is provided between a plurality of vertical members 100 arranged in the longitudinal direction as illustrated in FIG. 7, and connects a back surface part of one vertical member 100 with a front surface part of another vertical member 100.

Herein, the connection member 600 includes a body 610 which provides a space where the fork 10 of transport device is inserted since one side of a lower part of the body 610 is opened in a width direction and a connection part 620 protruded from both sides of the body 610 and extended so as to be inserted and coupled to a front surface part or back surface part of the vertical member 100.

Further, a third coupling part 615 having the same shape as the first coupling part 100 and corresponding thereto along a longitudinal direction is formed on an upper surface of the body 610 in order for the bracket 300 to keep on moving when being coupled to the vertical member 100.

Furthermore, the connection part 620 has a structure suitable to be inserted into the grid-type inner space 130 of the vertical member 100 through the front surface part or back surface part of the vertical member 100.

Moreover, a first insertion hole 140 may be formed in an upper part of the vertical member 100 in order to suppress separation of the connection part 620 inserted into the grid-type inner space 130 of the vertical member 100. A second insertion hole 630 may be formed on one side of the connection part 620 at a position corresponding to the first insertion hole 140 while the vertical member 100 is coupled to the connection member 600.

Figure 8:
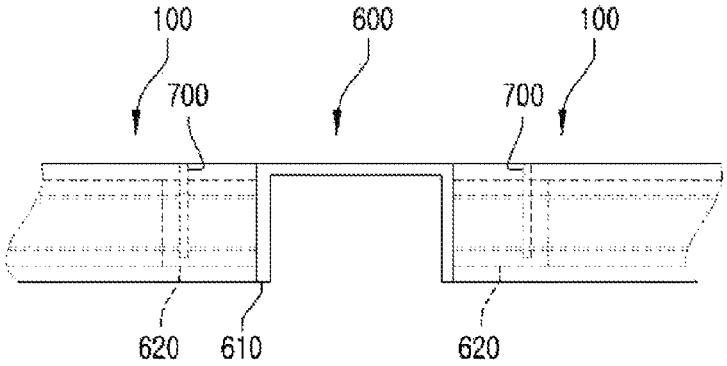
FIG. 8 is a side view illustrating coupling of the connection member according to the present invention.

Herein, a separation prevention means 700 penetrates into the first insertion hole 140 and the second insertion hole 630 while the vertical member 100 is coupled to the connection member 600 as illustrated in FIG. 8 and thus enhances a fixing force and suppresses separation from each other while the vertical member 100 is coupled to the connection member 600.

Accordingly, a vertical shaft is formed by continuously connecting the vertical member 100, the connection member 600, and the vertical member 100 in series, and the horizontal members 200 are orthogonally coupled on an upper part of the vertical shaft through the bracket 300, so that the pallet having a grid pattern is prepared.

Such a pattern provides a space that allows the fork 10 of transport device to be inserted from four directions unlike a conventional pallet including a space that allows the fork 10 of transport device to be inserted from two directions. Thus, the transport device can more easily and efficiently transport the pallet and goods loaded on the pallet regardless of direction.

5. Explanation of Coupling and Function of Wall Member Fixing Column and Wall Member of Prefabricated Pallet Referring to FIG. 9 and FIG. 10, the prefabricated pallet of the present invention may be prepared as a pallet having a grid pattern and serving as a support plate for transport of goods as illustrated in FIG. 3 by combination of the vertical member 100, the horizontal member 200, and the bracket 300. A wall member fixing column 800 and a wall member 900 may be installed on the prefabricated pallet, so that goods loaded on the prefabricated pallet may be transported in a box structure.

The wall member fixing column 800 is coupled to an upper edge of the horizontal member 200 and provides a coupling space for the wall member 900. More specifically, the wall member fixing column 800 includes: a column part 810; an outer insertion plate 820; an inner insertion plate 830; a contact plate 840; a rotating part 850; a column upper cover 860; and the like, but is not limited thereto.

The column part 810 is formed into a column shape and includes a third insertion hole 815 through which a column fixing means 950 such as a long bolt for coupling to an upper part of the horizontal member 200 is inserted at the center thereof.

Figure 9:
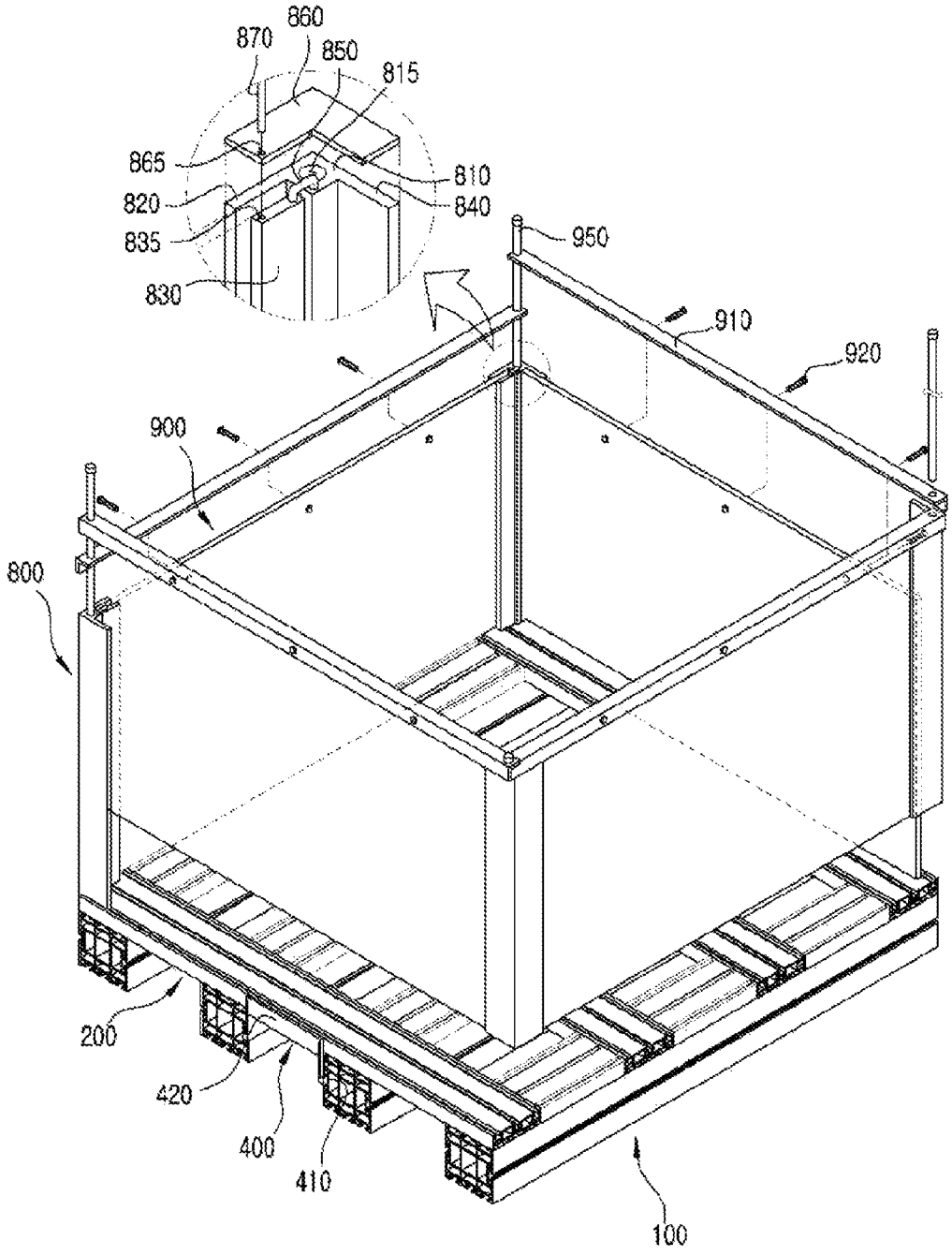
FIG. 9 is a perspective view illustrating coupling between a wall member fixing column and a wall member according to the present invention.
Figure 10:
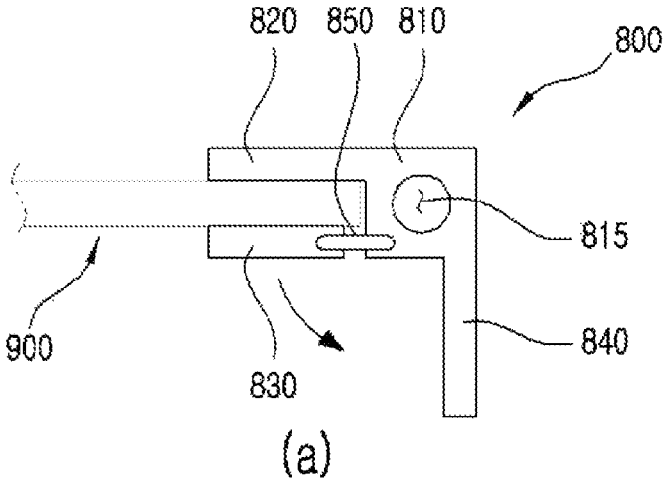
FIG. 10 schematically illustrates the wall member fixing column when the wall member is installed and disassembled according to the present invention.
Figure 10:
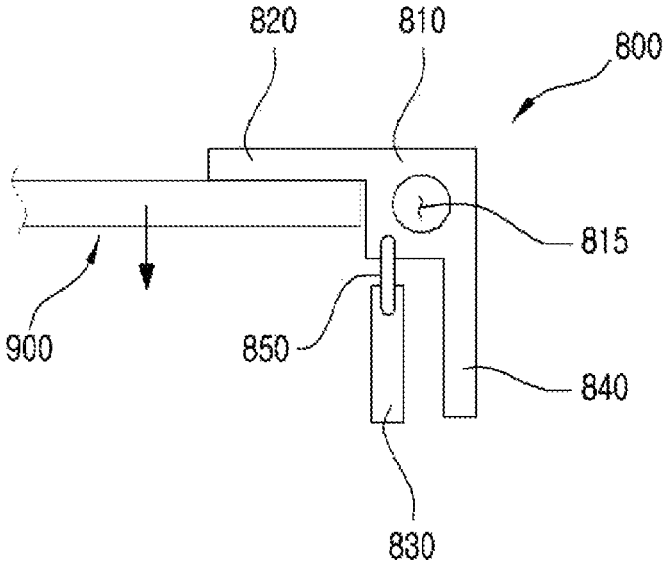

The outer insertion plate 820 and the inner insertion plate 830 are formed in one orthogonal direction of the column part 810 and provide a coupling space for insertion and fixing of the wall member 900 as illustrated in an enlarged view of FIG. 9. That is, the wall member 900 is coupled as being inserted and fixed in a space between the outer insertion plate 820 and the inner insertion plate 830 apart from each other.

The contact plate 840 is formed in the other orthogonal direction of the column part 810 and provides a coupling space for standing and fixing the wall member 900 as illustrated in the enlarged view of FIG. 9. That is, the contact plate 840 formed only on one side suppresses separation of the standing wall member 900 and is supplied with an enhanced fixing force by an angle 910 and a fastening means 920 to be described below.

One end of the rotating part 950 is connected to a lateral surface of the inner insertion plate 830 toward the column part 810 and the other end is connected to one side of the column part 810 adjacent to the inner insertion plate 830 in order for the inner insertion plate 830 to be rotatable around the other end connected to one side of the column part 810.

In other words, when the wall member 900 is installed, the inner insertion plate 830 is positioned in parallel to the outer insertion plate 840→820 and thus provides a coupling space for insertion and fixing of the wall member 900 as illustrated in FIG. 10A, and when the wall member 900 is disassembled, the inner insertion plate 830 is rotated to be orthogonal to the outer insertion plate 840→820 and thus facilitates disassembly of the wall member 900 as illustrated in FIG. 10B.

That is, it is not necessary for a user to lift the wall member 900 to be separated in a height direction of the pallet or to induce damage to a part of the wall member 900 in order to disassemble the wall member 900. Thus, it is possible to reduce waste generated during packaging and also possible to reduce costs and improve the environment by reusing the wall member 900.

A process of installing the wall member fixing column 800 and the wall member 900 will be explained in more detail. Firstly, the wall member fixing columns 810 are installed at four edges of the horizontal members 200 corresponding to corner points in a rectangular structure of the prefabricated pallet as illustrated in FIG. 9.

Then, the wall member 900 is positioned between the outer insertion plate 820 and the inner insertion plate 830 and inside the contact plate 840. The cover 860 is coupled to an upper surface of the wall member fixing column in order for the inner insertion plate 830 prepared to be rotatable to maintain formation of the coupling space and suppress movement thereof. An inner insertion plate fixing means 870 may be coupled through a fourth insertion hole 835 formed on one side of the inner insertion plate 830 and a fifth insertion hole 865 formed in the column upper cover 860 at a position corresponding to the fourth insertion hole 835.

Then, the angle 910 is positioned on an upper surface of the wall member 900 including four faces, and the angle 910 is fixed and coupled by the fastening means 920 such as a bolt and a nut.

Finally, an installer adds a fixing force by inserting and connecting the column fixing means 950 such as a long bolt in a downward direction from a position corresponding to the third insertion hole 815 in order to achieve integration by finally fixing the whole frame structure including the wall member fixing columns 800, the wall member 900, the column upper covers 860, and the angles 910 placed in sequence to the prefabricated pallet positioned under the whole frame structure. Herein, fixing by the column fixing means 950 such as a long bolt can be achieved using a means such as nuts connected to the top and the bottom of the column fixing means 950. In this case, the nut connected to the bottom may be positioned so as to be fastened to the column fixing means 950 inserted into a space formed on an upper part of the horizontal member 200 under the wall member 900 and moving down therein.

Further, a disassembly process is performed in reverse order of installation. However, the wall member 900 is removed in a state where the inner insertion plate 830 is rotated to be orthogonal to the outer insertion plate 840 as illustrated in FIG. 10B.

The exemplary embodiments of the present invention are provided for illustrative purposes only but not intended to limit the technical concept of the present invention. The scope of the technical concept of the present invention is not limited thereto. The protective scope of the present invention should be construed based on the following claims, and all the technical concepts in the equivalent scope thereof should be construed as falling within the scope of the present invention.

REFERENCE NUMERALS

10: Fork of transport device
100: Vertical member
110: First coupling member
113: First side holding plate
115: First center holding plate
117: First insertion space
119: First holding space
120: Third insertion space
130: Grid-type inner space
140: First insertion hole
200: Horizontal member
210: Second coupling member
213: Second side holding plate
215: Second center holding plate
217: Second insertion space
219: Second holding space
300: Bracket
310: Upper insertion plate
320: Lower insertion plate
330: Column plate
400: Protection member
410: Protection member fixing part
420: Protective surface
500: Auxiliary banding member
510: Coupling space
600: Connection member
610: Body
615: Third coupling part
620: Connection part
630: Second insertion hole
700: Separation prevention means
800: Wall member fixing column
810: Column part
815: Third insertion hole
820: Outer insertion plate
830: Inner insertion plate
835: Fourth insertion hole
840: Contact plate
850: Rotating part
860: Column upper cover
865: Fifth insertion hole
870: Inner insertion plate fixing means
900: Wall member
910: Angle
920: Fastening means
950: Column fixing means

What is claimed is:

1. A prefabricated pallet comprising:

a vertical member having a first coupling part formed in a longitudinal direction in which first side holding plates having a shape of "⌈" and "¬" are formed on an upper or lower surface of the vertical member so as to be directed toward the center thereof and provide a first insertion space and a first holding space, wherein third insertion spaces are provided on both sides of the vertical member in the longitudinal direction;

a horizontal member having a second coupling part formed in a longitudinal direction in which second side holding plates having a shape of "⌈" and "¬" are formed on a lower surface of the horizontal member so as to be directed toward the center thereof and provide a second insertion space and a second holding space;

a bracket that includes upper and lower insertion plates inserted into the first insertion space and the second insertion space and column plates inserted into the first holding space and the second holding space and formed between the upper and lower insertion plates; and a protection member that protects the horizontal member from a fork of transport device inserted into a space between adjacent vertical members for transport of the prefabricated pallet using a protective surface that is inserted into the space between the adjacent vertical members connected on the lower surface of the horizontal member, covers one side of the horizontal member, and includes a pair of protection member fixing parts respectively inserted into the third insertion spaces facing each other between the adjacent vertical members, the pair of protection member fixing parts being formed on both sides of the protection member, wherein the vertical member is orthogonally connected through the bracket with a predetermined gap on the lower surface of the horizontal member.

2. The prefabricated pallet of claim 1, further comprising:

a wall member fixing column that is coupled to an upper edge of the horizontal member and provides a coupling space for a wall member, wherein the wall member fixing column includes:

a column part that is formed into a column shape and includes a third insertion hole through which a column fixing means for coupling to an upper part of the horizontal member is inserted at the center thereof;

inner and outer insertion plates that are formed in one orthogonal direction of the column part and provide a coupling space for insertion and fixing of the wall member;

a contact plate formed in the other orthogonal direction of the column part and provides a coupling space for standing and fixing the wall member; and a rotating part of which one end is connected to a lateral surface of the inner insertion plate toward the column part and the other end is connected to one side of the column part adjacent to the inner insertion plate in order for the inner insertion plate to be rotatable around the other end connected to the one side of the column part.

3. The prefabricated pallet of claim 1, wherein the protection member is formed of a material having elasticity, and the protective surface covering the one side of the horizontal member is formed into a curved shape with a predetermined curvature.

4. The prefabricated pallet of claim 1, further comprising:

auxiliary banding members that are inserted into the third insertion spaces and provide coupling spaces for a banding means to be fastened.

5. The prefabricated pallet of claim 1, wherein an inner space of the vertical member is formed into a grid pattern divided by a plurality of rectangular frames.

6. The prefabricated pallet of claim 5, further comprising:

a connection member that is installed between a plurality of vertical members arranged in a longitudinal direction and connects a back surface part of one vertical member to a front surface part of another vertical member, wherein the connection member includes:

a body which provides a space where the fork of transport device is inserted since one side of a lower part of the body is opened in a width direction and includes a third coupling part having the same shape as the first coupling part on an upper surface thereof; and a connection part protruded from both sides of the body and extended so as to be inserted and coupled to the front surface part or back surface part of the vertical member.

7. The prefabricated pallet of claim 6, wherein the connection part has a structure corresponding to a divided grid pattern of the vertical member so as to be inserted into the inner space through the front surface part or back surface part of the vertical member.

8. The prefabricated pallet of claim 7, wherein a first insertion hole through which a separation prevention means is inserted is formed in an upper part of the vertical member, and a second insertion hole is formed on one side of the connection part in a height direction at a position corresponding to the first insertion hole.

* * * * *